United States Patent [19]

Faist

[11] 4,101,083

[45] Jul. 18, 1978

[54] HOUSING FOR ROLL STANDS FOR GRINDING CEREALS OR SIMILAR MATERIAL

[75] Inventor: Walter Faist, Vechelde, Fed. Rep. of Germany

[73] Assignee: Buhler-Miag GmbH, Braunschweig, Fed. Rep. of Germany

[21] Appl. No.: 775,984

[22] Filed: Mar. 9, 1977

[30] Foreign Application Priority Data

Mar. 13, 1976 [DE] Fed. Rep. of Germany ..... 2610742

[51] Int. Cl.[2] ..... B02C 4/02; B02C 23/00

[52] U.S. Cl. ..... 241/285 R; 248/13

[58] Field of Search ..... 241/159, 227, 285 R, 241/285 A, 285 B; 248/13

[56] References Cited

U.S. PATENT DOCUMENTS

| | | | |
|---|---|---|---|
| 344,258 | 6/1886 | Dunne | 241/285 R |
| 1,743,911 | 1/1930 | Borton | 241/285 A |
| 2,568,783 | 9/1951 | Woodruff | 241/285 R |
| 3,899,965 | 8/1975 | Koch et al. | 241/285 B X |

*Primary Examiner*—Howard N. Goldberg
*Attorney, Agent, or Firm*—Michael J. Striker

[57] ABSTRACT

A housing for roll stands for grinding cereals or similar material comprises a support structure including a pair of rectangular transversely spaced vertical frames connected to each other at the lower bars thereof by transverse bars serving as support plates for bearing blocks of the roll stands. Transverse vertical plates adjacent to the transverse bars extend also parallel to the latter transversely between the frames to partly enclose a space in which a grinding operation is to be performed. The transverse vertical plates are formed with cutouts open toward one of the frames. Walls connected to the frames further enclose the aforementioned space and the walls on the one frame are releasably connected or hinged thereto for clearing the opening defined by the one frame, so that a roll stand may be pushed in or removed from the support structure through the thus cleared opening in the one frame.

4 Claims, 3 Drawing Figures

HOUSING FOR ROLL STANDS FOR GRINDING CEREALS OR SIMILAR MATERIAL

BACKGROUND OF THE INVENTION

The present invention relates to a housing for roll stands for grinding of cereals or similar material with a supporting structure for receiving the rolls, as well as cover means for dust-tightly enclosing the space in which the grinding operation is to be performed.

Housings for roll stands are usually cast or made from sheet metal steel welded constructions which receive the bearings of a pair of roll or a plurality of roll pairs individually on the side walls thereof. The mounting on or removal of the rolls from the housing in these constructions is carried out in the direction of the longitudinal axes of the rolls, and this requires therefore a free space corresponding to the length of the rolls laterally of the housing. This, in turn, requires, in a grinding mill provided with a plurality of roll stands, relatively large distances between the roll stand rows and therefore a considerable increase of the necessary mounting surface and space for such an arrangement.

In order to avoid lateral removal of the rolls and to permit exchange thereof in a simple manner and during a short time period, constructions are already known (German Pat. Nos. 671,248 and 840,790) in which the roll stand housings are split in the region of the roll bearings so that, after lifting the upper housing part, the bearings of all rolls are easily accessible, so that the rolls including the bearings thereof may be lifted from the housing. While these known constructions have the advantage of facilitating exchange of the rolls, they have the disadvantage that they require complicated and therefore expensive housing constructions.

A roll stand is further known (Deutsche Offenlegungsschrift No. 23 30 824) for fine comminuting and dispersing of pastelike material to be ground, in which in a support structure, which may be constructed of two parts, and which comprises transversely spaced support rails with four supporting blocks, a roll package including a plurality of rolls is mounted, which rest by means of frames on the support blocks on the supporting rails. The two vertically arranged frames consist in this case each of two parallel guide rods which are connected at the ends thereof by traverse members and which receive the housings for the roll bearings. This construction is designed for the mounting of a single roll stand aggregate and is not suitable for the super position of a plurality of roll stands, as is necessary for grinding of goods which have to pass between the rolls of a plurality of roll stands.

SUMMARY OF THE INVENTION

It is an object of the present invention to provide a housing for roll stands, for grinding of cereals or similar material, which avoids the disadvantages of such roll stands known in the art.

It is a further object of the present invention to provide a housing for such roll stands which permits a simple, time-and space-saving mounting of and dismounting of the rolls from the housing in a direction substantially normal to the roll axes.

It is an additional object of the present invention to provide a housing for such roll stands which is of relatively light construction and which is suitable for superimposing a plurality of roll stands so that the material to be ground may pass through the nip of roll pairs which are superimposed upon each other.

With these and other objects in view, which will become apparent as the description proceeds, the housing for roll stands for grinding of cereals or similar material comprises, according to the present invention, a support structure including a pair of rigid vertical frames each having an internal length greater than a roll stand to be mounted in the housing and a pair of transverse bars connecting the frames in spaced relationship to each other, as well as cover means connected to the support structure for enclosing the space in which the grinding operation is to be performed. Each frame is preferably of rectangular configuration and includes a lower horizontally extending bar, an upper horizontally extending bar and two vertically extending bars respectively connecting said horizontally extending bars at opposite ends to each other, in which the transverse bars preferably connect the lower bars of the frames to each other and are constructed as support plates for supporting bearing blocks of the roll stands. According to a further feature of the present invention, a pair of transverse vertical walls extend spaced from each other and from opposite ends of the frames between the latter and partly enclosing a space within the support structure in which the grinding operation is to be performed. The transverse walls are formed with cutouts for pushing the roll stands into the support structure. Each of the roll stands preferably includes a pair of cover plates for masking the cutouts in the transverse walls when the roll stands are pushed into the support structure. The transverse walls together with the cover plates will laterally seal the space in which the grinding operation is to be performed against penetration of dust into the surrounding atmosphere. In order to seal the housing also at the front and rear side against penetration of grinding dust into surrounding atmosphere, further walls are connected to the frames for closing the openings defined by the same and at least the walls closing the opening defined by the one frame are connected thereto to be removable therefrom or hinged thereon for clearing the opening thereof. The frames are further provided with cutouts, such as slits or bores, for connecting of fastening elements in order to connect a plurality of housings superimposed and properly aligned with each other and to secure the lowermost of such superimposed housings to a foundation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
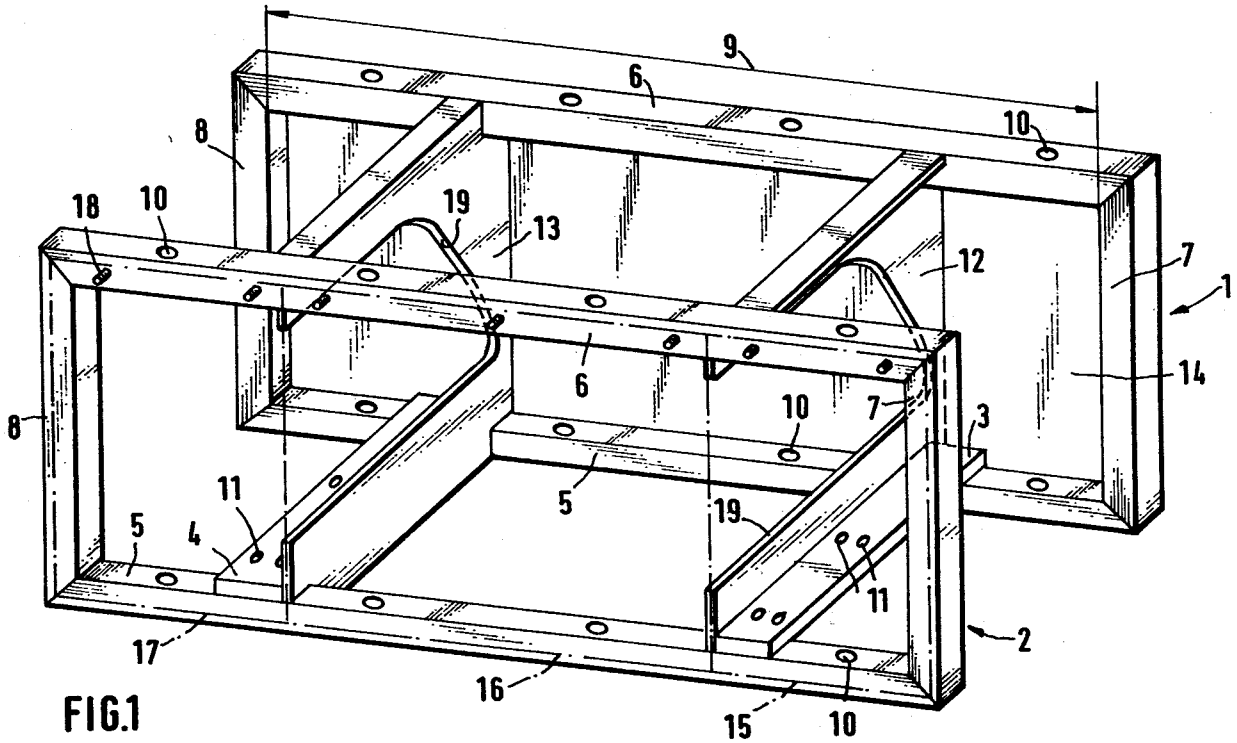
FIG. 1 is a simplified perspective illustration of a roll stand housing.

The housing for roll stands, for grinding of cereals or similar material, comprises, as shown in FIG. 1, a support structure for receiving a roll stand and provided with means for sealing the space in which the grinding operation is to be performed against penetration of grinding dust toward the outer atmosphere.

The support structure includes a pair of rigid vertical rectangular frames 1 and 2 and a pair of transverse bars in form of supporting plates 3 and 4 connecting the frames in spaced relationship to each other. Each of the frames 1 and 2 comprises a horizontal lower bar 5, a horizontal upper bar 6, as well as two vertical bars 7 and 8 respectively connecting the horizontally extending bars at opposite ends to each other. The bars 5–8 are hollow profiles which are connected to each other by welding. The frames 1 and 2 are dimensioned in such a manner that the internal length 9 is slightly longer than the length of a roll stand to be mounted therein. To fix the housing to a foundation, or to connect superimposed housings in proper alignment with each other by screws, the horizontally extending bars 5 and 6 of the frames 1 and 2 are provided with bores 10. The transverse bars 3 and 4 are also provided with bores 11 for mounting bearing blocks of roll stands thereon.

Figure 2:
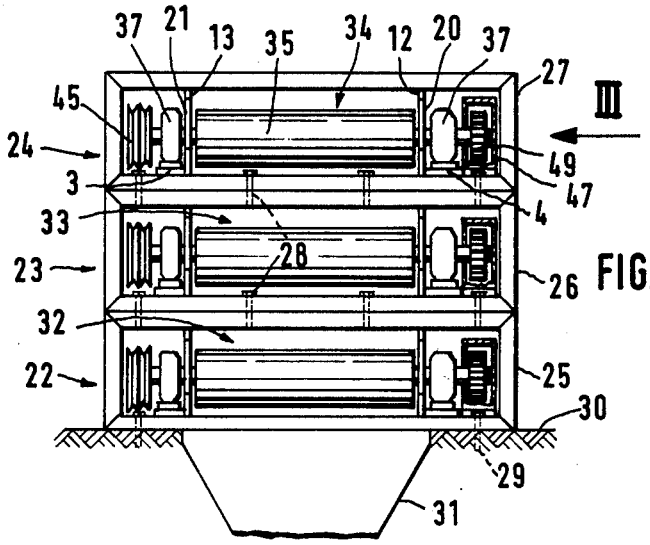
FIG. 2 is a schematic front view of a six-roll grinding mill with three superimposed roll stands.

The cover means for the housing include vertical transverse walls 12 and 13, each provided at the upper end thereof with a portion extending normal to the remainder of the transverse walls. The transverse walls 12 and 13 are arranged closely adjacent to the transverse bars 3 and 4 and welded to the latter as well as to the frames 1 and 2. The cover means include further a rear wall 14 connected for instance by screws, not shown in the drawing to the frame 1 and a front wall formed from three wall portions 15, 16 and 17, which abut with lateral edges thereof against each other. These front wall portions 15–17 are only indicated in dash-dotted lines in FIG. 1 and are connected to the frame 2 by hinges, not shown in the drawing, provided on the lower horizontal bar 5 of the frame 2. Threaded pins 18 projecting from the upper bar 6 of the frame 2 serve in connection with non-illustrated wing nuts to releasably maintain the tiltable front wall portions 15–17 in upright position in which they cover the opening defined by the frame 2. Each of the transverse walls 12 and 13 is formed with a cutout 19, which is open toward the frame 2, for inserting the roll stands into the support structure. The roll stands are provided, as shown in FIG. 2 with cover plates 20 and 21 to substantially close the cutout 19, when the roll stands are inserted into the support structure. Depending on the use of the roll stands, a discharge funnel 31 for discharging the ground material may be connected to the bottom of the housing, and/or feeding means for feeding the material to be ground may be connected to the upper end of the housing.

FIG. 2 illustrates an arrangement in which three housings according to the present invention are superimposed upon each other to form a six-roll grinding mill with three superimposed roll stands 22, 23 and 24 for grinding for instance coffee beans. In this arrangement three housings, as shown in FIG. 1 and as described above, are superimposed aligned with each other in which roll stands 22, 23 and 24 are respectively mounted. The housings 25, 26 and 27, each constructed as shown in FIG. 1, are connected by screws 28 in properly aligned relationship to each other and the thus-formed housing block is connected by screws 29 on the foundation 30. The material to be ground is fed into the nip between the rolls of the uppermost roll stand 24 by means of a feeding apparatus of known construction, not forming part of the present invention and therefore not illustrated in the drawing, whereas discharge of the ground material from the lowermost roll stand 22 is performed by means of a discharge funnel 31.

Figure 3:
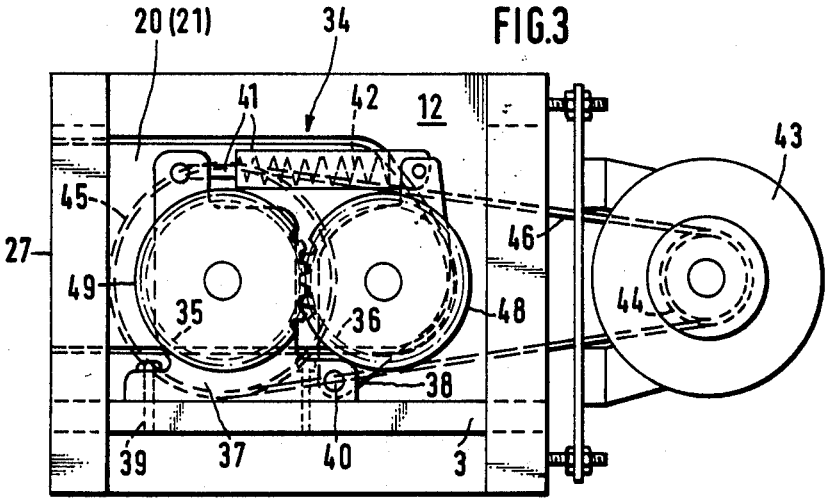
FIG. 3 is a side view of a roll stand of the six-roll grinding mill shown in FIG. 2, as viewed in the direction of the arrow III in FIG. 2, whereby the housing for the drive of the roll stand is, for simplification reasons, omitted in FIG. 3.

Each of the roll pairs 32, 33 and 34 respectively arranged in the housings 25, 26 and 27 comprise, as shown in FIG. 3, a roll 35, the trunnions of which are mounted for rotation about the axis thereof in bearing blocks 37 mounted in stationary position by screws 39 on the support plates 3 and 4, respectively, and a roll 36, the trunnions of which are mounted for rotation about their axis in bearing levers 38. The bearing levers 38 are pivotally connected at one end by pivot pins 40 to the respective bearing blocks 37, whereas the other ends of the bearing levers 38, are connected by mechanical connecting means 41 to upwardly projecting portions of the bearing blocks 37. Each of the connecting means 41 comprise a rod pivotally connected at one end to the respective stationary bearing clock 37 and extending into a tubular member pivotally connected at one end thereof to the other end of the respective bearing lever 38, with a coil compression spring 42 sandwiched between abutments on the other end of the tubular member and the other end of the rod so that the outer periphery of the roll 36 is yieldably held against the outer periphery of the roll 35. The rolls 35 and 36 are driven by an electric motor 43, mounted on the rear side of the respective housing, by means of a pulley 44 fixed to the output shaft of the motor 43, a V-belt 46 and a corresponding pulley 45 fixed to the roll 35. The roll 36 is driven from the roll 35 by meshing gears 48, 49 respectively mounted on the trunnions of the two rolls. The gears 48 and 49 are preferably mounted in a separate gear housing 47. As shown in FIGS. 2 and 3, the cover plates 20 and 21, for closing the cutouts 19, in the transverse walls 12 and 13, are mounted on the trunnions of the rolls 35 and 36 and connected in any convenient manner, not shown in the drawing, to the transverse walls 12 and 13.

If the rolls in a pair of rolls become defective for any reason whatsoever and have to be exchanged, for instance the pair of rolls at the lowermost roll stand 22, then the cover plates 15–17 of the housing 25 are released and flapped downwardly. Subsequently thereto the respective V-belt drive is removed, the connections between cover plates 20, 21 and the transverse walls 12, 13 released and the screws 39 unscrewed. Subsequently thereto the complete roll stand 22 may be pulled out through the opening in the frame 2 and be replaced by new roll stand 22, or after replacing the two rolls in the roll stand 22, the latter may be again be placed into the housing 25. The housing 25 can remain in place during such exchange and evidently does not hinder the same in any way whatsoever.

The housing of the present invention has advantages as compared with such housings known in the art. The housing of the present invention may be constructed of generally available profiles and has by equal stability a considerable smaller weight than such housings known in the art. Furthermore, the housing of the present invention is especially suitable for superimposing a plurality of roll stands upon each other and in addition it has the advantage that the roll stands mounted therein can be easily and quickly repaired, respectively exchanged and the housing permits also easy access to the rolls of the roll stands for proper maintenance of the same.

It will be understood that each of the elements described above, or two or more together, may also find a useful application in other types of housings for roll stands for grinding cereals or similar material differing from the types described above.

While the invention has been illustrated and described as embodied in a housing for roll stands for grinding of cereal or similar material, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A housing for roll stands for grinding cereals or similar material comprising a support structure including rigid, vertical frames each having an internal length greater than a roll stand to be mounted in said housing; a pair of transverse bars connecting said frames in spaced relationship to each other; and cover means connected to said support structure for enclosing a space in which the grinding operation is to be performed, said cover means including a pair of vertical transverse walls extending spaced from each other and spaced from opposite ends of said frames between the latter for partly enclosing said space, each of said transverse walls being formed with a cutout permitting frontal insertion of a roll stand into the support structure and removing a roll stand therefrom.

2. A housing as defined in claim 1, wherein said cutouts are open towards one of said frames.

3. A housing as defined in claim 2, wherein the roll stand to be mounted in the housing includes a pair of cover plates for masking the cutouts in said transverse walls.

4. A housing as defined in claim 2, wherein said cover means further comprise walls connected to said frames for closing the opening defined by each frame, and means connecting said walls to said frames, at least the means connecting the walls to said one frame are constructed so that the walls connected thereto may be quickly moved for clearing the opening defined by said one frame.

* * * * *